12/10/85 OR 4,558,324 32

United States Patent [19]

Clapp

[11] Patent Number: 4,558,324

[45] Date of Patent: Dec. 10, 1985

[54] MULTIBEAM LENS ANTENNAS

[75] Inventor: Roger E. Clapp, Cambridge, Mass.

[73] Assignee: The United States of America as represented by the Secretary of the Air Force, Washington, D.C.

[21] Appl. No.: 511,591

[22] Filed: Jul. 7, 1983

[51] Int. Cl.[4] ..... H01Q 15/02

[52] U.S. Cl. ..... 343/754; 343/783; 343/911 L

[58] Field of Search ..... 343/753, 754, 783, 909, 343/911 R, 911 L

[56] References Cited

U.S. PATENT DOCUMENTS

| | | | |
|---|---|---|---|
| 2,653,239 | 9/1953 | Chu et al. | 343/783 |
| 3,116,486 | 12/1963 | Johnson et al. | 343/755 |
| 3,359,560 | 12/1967 | Horst | 343/911 |
| 3,550,139 | 12/1970 | McFarland | 343/754 |
| 3,656,165 | 4/1972 | Walter et al. | 343/754 |
| 3,754,270 | 8/1973 | Thies, Jr. | 343/754 |
| 3,761,935 | 9/1973 | Silbeger et al. | 343/754 |

OTHER PUBLICATIONS

Wide-Angle Microwave Lens for Line Source Applications, W. Rotman & R. F. Turner, IEEE Transactions on Antennas and Propagation, vol. AP-11, pp. 623-632, Nov. 1963.

Donald H. Archer, "Lens-Fed Multiple Beam Arrays", Electronic Progress (Raytheon Co.), vol. XVI, No. 4, pp. 24-32, Winter 74.

David T. Thomas, "Multiple Beam Synthesis of Low Sidelobe Patterns in Lens Fed Arrays," IEEE Transactions on Antennas and Propagation, vol. AP-26, pp. 883-886, Nov. 1978.

*Primary Examiner*—Eli Lieberman

*Attorney, Agent, or Firm*—Donald J. Singer; Bernard E. Franz

[57] ABSTRACT

Multibeam lens antennas are often circular, and utilize propagation in disk-shaped parallel-surface regions. There is phase correction through terms in $\theta^2$, where $\theta$ is the angle of an aperture point measured from the boresight direction. In the new designs herein, the lens comprises two portions, each being two closely spaced plates with a dielectric medium between them. One portion is formed as a surface of revolution (cylindrical or conical) with two circular ends, one end being an aperture with element feedpoints coupled to array elements. The other portion is a cap joined to the other end of the first portion. The cap may be a disk or a segment of a sphere. The dimensions and indices of refraction are selected to provide focus points for feed ports, with each focus being for a specific beam direction. The parameters may be selected so that the focus points are within the cap, at the periphery of the cap, or at the aperture. Some of the new designs have phase correction through $\theta^2$ and $\theta^4$, while others have phase correction through $\theta^2$, $\theta^4$, and $\theta^6$.

18 Claims, 13 Drawing Figures

BOOTLACE LENS CONCEPT

R-KR LENS CONCEPT

CYLINDER-DISK LENS I

CYLINDER-DISK LENS II

CYLINDER-DISK LENS III

CYLINDER-SPHERE LENS

CONE-SPHERE LENS II

CONE-SPHERE LENS I

CYLINDER-DISK GEOMETRY I

CYLINDER-DISK GEOMETRY II

CYLINDER-SPHERE GEOMETRY

MULTIBEAM LENS ANTENNAS

RIGHTS OF THE GOVERNMENT

The invention described herein may be manufactured and used by or for the Government of the United States for all governmental purposes without the payment of any royalty.

BACKGROUND OF THE INVENTION

This invention relates to multibeam lens antennas, particularly for radar systems.

Basic background information may be found in the "Radar Handbook", Merrill Skolnik, Editor-in-Chief, McGraw-Hill Book Company, New York, 1970, and the references cited therein. Lens antennas are covered in section 10.9, and multibeam forming in Section 11.9.

The following items are referenced by number in he "Detailed Description" herein, and provide significant background information:

1. Walter Rotman and R. F. Turner, "Wide-Angle Microwave Lens for Line Source Applications", IEEE Transactions on Antennas and Propagation, Vol. AP-11, pp. 623–632, November 1963.
2. Donald H. Archer, "Lens-Fed Multiple Beam Arrays", Electronic Progress (Raytheon Company), Vol. XVI, No. 4, pp 24–32, Winter 74.
3. Wilbur H. Thies, Jr., "Omnidirectional Multibeam Antenna," U.S. Pat. No. 3,754,270, Aug. 21, 1973.
4. David T. Thomas, "Multiple Beam Synthesis of Low Sidelobe Patterns in Lens Fed Arrays," IEEE Transactions on Antennas and Propagation, Vol. AP-26, pp. 883–886, November 1978.

Other U.S. Patents of interest include U.S. Pat. No. 3,359,560 to Horst which discloses a cylindrical dielectric lens comprising a mass of dielectric beads supporting an array of randomly oriented insulated metallic slivers in the interstices between the beads. U.S. Pat. No. 3,761,935 to Silbiger et al. discloses a wide-angle microwave scanning antenna array which includes an assembly of two stationary, parallel, concentric, spaced cylindrical surfaces providing a path for microwaves. U.S. Pat. No. 3,116,486 to Johnson et al. discloses a lens system in which electromagnetic waves incident on a Luneburg lens sphere are focused by the lens to a focal point on the opposite surface of the sphere. U.S. Pat. No. 3,550,139 to McFarland discloses a dielectric lens being shaped as a sector of a hemisphere and having a spherical surface of the sector being less than 180°. U.S. Pat. No. 3,656,165 to Walter et al. discloses a geodesic Luneburg lens antenna which when excited by a single dual polarized feed will produce two divergent beams, one horizontally and the other vertically polarized, which has a circular lens aperture, a conical portion and a contoured portion. Excitation of the Walter et al. lens by two separate feeds at particular locations will result in the capability of providing arbitrary elliptical polarization including linear and circular polarization.

SUMMARY OF THE INVENTION

An object of the invention is to provide a multibeam lens antenna having reduced residual phase errors, to improve the side-lobe performance.

The structure according to one embodiment of the invention comprises a cylindrical portion and a disk portion for directing incident rays of an incoming plane wave to a predetermined focal point. The incoming plane wave is first incident upon a circular arc, and then it is coupled into a parallel-plate propagation waveguide lying between two closely spaced cylindrical surfaces. The lower edge of the parallel-plate propagation waveguide is joined to a flat disk-shaped parallel-plate waveguide which directs incoming rays to the predetermined focal point. By varying the geometry of the lens, the location of the focal point can be changed.

In other embodiments of the invention, the cylinder and/or disk are replaced by other forms. In general, the lens structure comprises first and second portions, in the first portion the plates being surfaces of revolution about an axis, with first and second ends thereof being circles in planes perpendicular to the axis, the first end being the aperture; the second portion forming a cap with a circular periphery joined to the first portion at its second end; the dielectric constant and therefore the index of refraction being constant within each portion.

The first portion may be cylindrical or conical (truncated at the second end). The second portion may be a disk or spherical.

DETAILED DESCRIPTION

Figure 1:
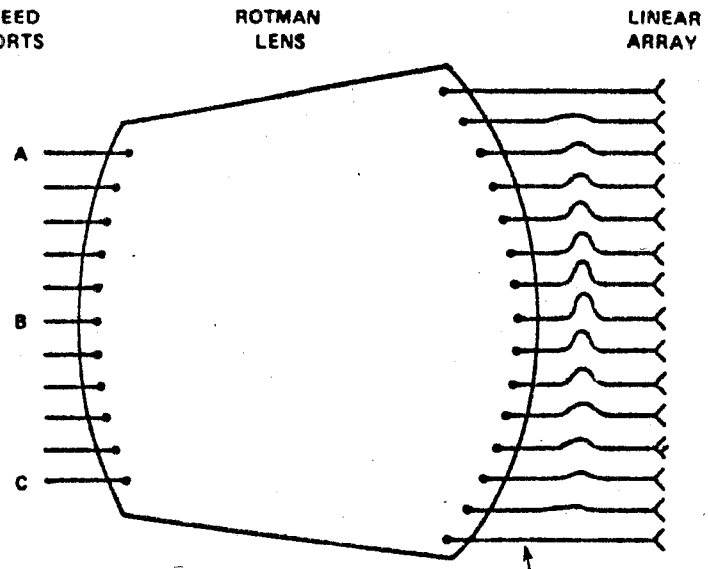
Fig. 1 Prior Art
FIGS. 1 and 2 are symbolic diagrams of prior art multibeam lens antennas.

The multibeam lens antennas of FIGS. 1–8 all have a lens geometry comprising closely spaced metal plates with a dielectric medium between the plates. The spacing in general is not critical, three-eights wavelength, for example, being suitable. The dielectric in each portion is homogeneous and isotropic for the dielectric constant. This is in contrast to a typical Luneburg lens which is inhomogeneous with variable regractive index. The cross section views of FIGS. 1A and 3A show parallel plates and RF coupling which may be considered as typical for all of the figures. Each embodiment has several element ports along the aperture, and also a plurality of feed ports. At both element ports and feed ports, probes to coaxial cables and horns are representative of the many possible types of RF coupling to the lenses. The operation is based upon the TEM mode of propagation through the parallel plate structure acting as a waveguide.

Multibeam Antenna Design Concept

1. Sidelobe Limitations of Existing Lens Antennas

The existing multibeam lens antennas include some in which the radiating aperture is flat, and others in which the radiating aperture is on a circular arc, in some cases a complete circle.

a. Flat Aperture

The designs using flat aperture are limited as to the coverage sector obtainable with a single multibeam antenna, though a full 360° coverage can be obtained with three or four such flat-aperture multibeam antennas.

The individual beams from a flat-aperture antenna will not be identical. The azimuth beamwidth, in particular, will ordinarily be narrowest for the broadside beam, and somewhat wider for other beams because the effective horizontal aperture is reduced by projection, by the factor cos $\phi$, if $\phi$ is the beam angle relative to the broadside direction.

Furthermore, the phasing along a flat aperture, needed to point a fan beam in the direction $\phi$, will at the same time create a fan which is conical in its shape. If the elevation beamwidth is narrow, the difference between a conical fan and a flat vertical fan may be of little practical consequence. For targets at a high elevation angle, however, the conical shape of the beam should be reckoned into the data processing.

The conical shape of the beam, the restricted angular sector coverage from a single antenna, and the dependence of beamwidth upon projected aperture are all limitations on the performance of a flat-aperture multibeam antenna. However, none of these limitations would prevent the use of such an antenna in a multistatic radar receiving system, or in other systems applications. Allowance could be made for all of these limitations in the system design.

b. Curved Aperture

Multibeam antennas have also been designed to use a radiating aperture which is curved to follow a circular arc. This arc is ordinarily extended upward to form a circular cylinder. The cylindrical surface then radiates with one portion of this surface being active in the generation of one particular beam. Other overlapping portions, appropriately phased, form other beams in the multibeam set.

With the radiation coming from a circular arc or a cylindrical surface, the phasing over the aperture can be adjusted to form an optimized beam at a particular elevation angle. This will ordinarily be a zero elevation angle (the horizon), or a few degrees above the horizon. If the phasing optimizes the horizon beam direction, then a fan beam will have its beamwidth slightly broader at elevation angles significantly above the horizon. If the phasing optimizes the beam a few degrees above the horizon, then the horizon portion of the fan beam will have a slightly broadened beamwidth, as will the part of the fan beam which is directed higher than the optimization elevation angle.

With a circular arc or cylindrical surface as the radiating aperture, considerations of circular symmetry show that each antenna beam will be just like the next, if the antenna structure extends around a full circle. Even if the structure is truncated, and one physical antenna is used for beams covering only a limited angular sector, the beams should all be very much like each other, as long as the radiating sector forming a beam is not seriously truncated by the edge of the physical antenna.

c. Phase Errors

For a multibeam antenna to have very good sidelobe performance, the illumination across the radiating aperture should be carefully controlled in both phase and amplitude. Incorporating an appropriate amplitude taper, such as a 40-db Taylor illumination, will give close to the theoretical 40-db sidelobes, but only if the phasing across the aperture matches the phasing for a radiated plane wave. If there is phase distortion over the radiating aperture, then the sidelobe performance will deteriorate, even if the amplitude taper is kept close to the design illumination function.

Most of the presently used multibeam antennas, both flat-aperture and curved-aperture, utilize lens concepts for generating the appropriate phasing across the aperture. However, the lens concepts in use are very approximate in their ability to provide an accurate phase match between the phasing over the aperture and the phasing for a plane wave.

The phase error, for a particular lens concept, can be expressed as a power series in a variable measuring the position across the radiating aperture. For the flat aperture, this variable will be a linear distance, measured from the aperture center. For the curved aperture, this variable can be taken as an angle $\theta$, with the center of the radiating aperture denoted by $\theta=0$. The phase error for the curved aperture will ordinarily be expressible as a power series in which no odd powers of the variable $\theta$ appear. This restriction to even powers arises from the circular symmetry of the lens structure and the radiating structure. For the flat aperture, both even and odd powers of the aperture variable may appear in the phase-error polynomial.

Figure 1A:
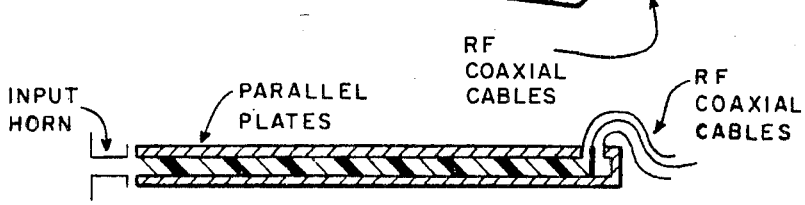
FIGS. 1A and 3A are cross section views of the lens structures of FIGS. 1 and 3, respectively.

For feeding a flat multibeam antenna array, the Rotman lens concept of FIGS. 1 and 1A is in general use (reference 1). This "bootlace" design is a parallel-plate lens in which there is optimized phase compensation for three beam directions corresponding to the three feed ports at A, B, and C, the two ends and the center of the set of feed ports. For these three feed locations, the propagation distances to the element ports produce a linear phasing along the array elements, which are connected to the element ports by measured-length cables.

For the other feed locations along the feed arc, the phasing of the array elements is not quite so linear. The sidelobe performance of such an antenna is not outstanding, though it is adequate for many applications. The use of a high dielectric constant in the parallel-plate region permits the physical lens structure to be small and compact.

Figure 2:
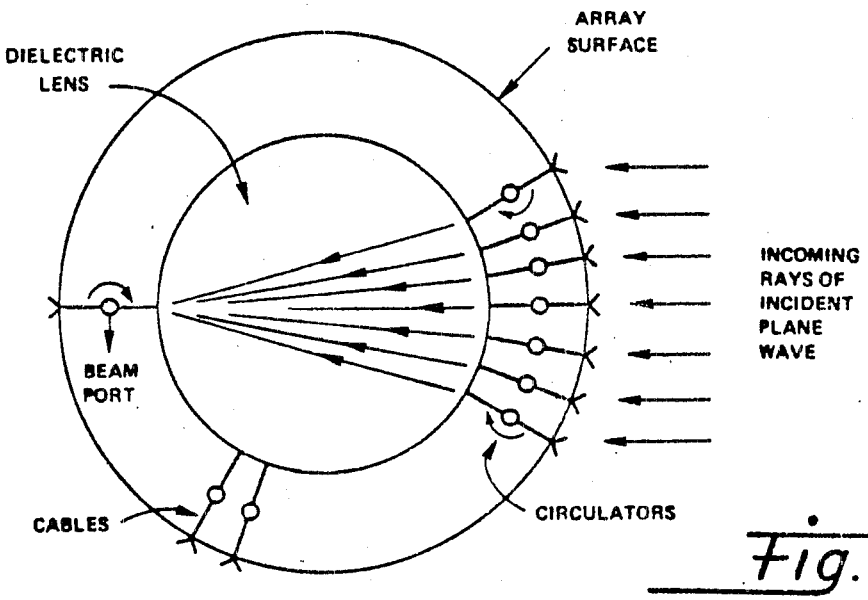
Fig. 2 Prior Art

For feeding a curved multibeam antenna array, the lens of FIG. 2 is ordinarily used (references 2 and 3). This "R-KR" lens is also a parallel-plate lens, but the dielectric constant is important in the mathematics of the phase compensation.

The radius and index of refraction in the disk region are adjusted to fix the electrical length across a diameter. If this length is given as 2 KR, where R is the array radius, then choosing $K=2.0$ will make the $\theta^2$ term in the phase-error polynomial vanish exactly. In practice, the disk parameters are usually adjusted to give $K=1.9$. This partially counteracts the effect of the $\theta^4$ error term through inserting a small $\theta^2$ term which is opposite in sign.

Because of the residual phase errors that remain, with either of these two lens designs, the sidelobe performance that is possible is not very good, particularly in comparison with single-beam antennas whose phasing can be kept very precise so that a suitable amplitude taper will be effective in reducing sidelobe level.

2. Improved Lens Antenna Designs with Higher Order Phase Corrections

Several alternative lens geometries have been designed, some of which provide phasing which is mathematically considerably more precise than the design of FIGS. 1 and 2.

Figure 3:
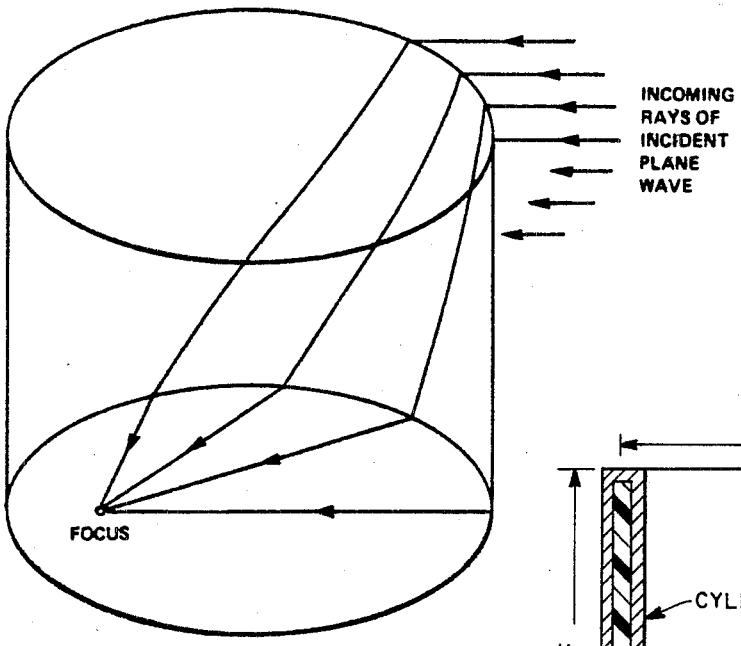
FIGS. 3–5 are symbolic diagrams of cylinder-disk lenses.
Figure 3A:
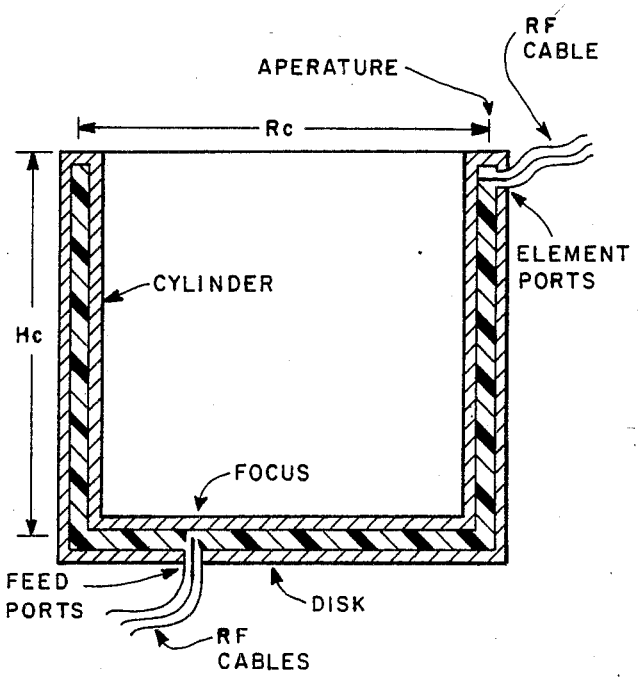

The first of these new lens designs is shown in FIGS. 3 and 3A. The incoming plane wave can be thought of as incident on a circular arc, where it is coupled into a parallel-plate propagation region lying between two closely spaced cylindrical surfaces. The actual coupling mechanism could be similar to that used with the lens designs of FIGS. 1 and 2.

Propagation in the cylindrical parallel-plate region takes place along rays such as those indicated in FIG. 3, down to the lower edge of the cylindrical section of the lens. At this lower edge, the cylindrical parallel-plate waveguide is joined to a flat disk-shaped parallel-plate waveguide, and the propagating rays are turned to pass horizontally through this horizontal region.

If the dimensions are chosen properly, these rays will cross at a focal point, as shown in FIG. 3.

If the medium in both of the parallel-surface propagating regions has the same dielectric constant, then the most precise focusing takes place when the height of the cylinder equals the product of the radius of the cylinder and the square root of three:

$$H_c = R_c\sqrt{3}\ . \tag{1-1}$$

The focal point is then located at a radius given by $$R_f = R_c/\sqrt{3} = H_c/3. \tag{1-2}$$

There are two practical difficulties with the lens design of FIG. 3, neither of them insurmountable. One difficulty arises when a single lens is used for forming a full 360° circle of beams. In this case, the rays passing toward one focal point from the edge of the disk will cross other active focal points. A directive coupling mechanism such as a short array of slots is needed to abstract the energy at one focal point without interfering with the signal rays moving toward other focal points. Suitable directive slot arrays can be designed, but their performance may prove to be inadequate in practice, leading to an inadvertent coupling between different beams that could partially defeat the purpose of the multibeam antenna. In this case, several lens antennas should be used, with only a limited angular sector to be covered by any one lens antenna. Only a partial set of focal points would be equipped with output coupling devices, in any one lens antenna. No ray in the disk region would then have to pass across one active focal point output coupling structure on its way to its true focus.

The second practical difficulty, with the lens design of FIG. 3, arises as a result of the 90° joint between the lower disk-shaped parallel-plate region and the cylindrical propagating region. This joint could introduce reflections, if it is not very carefully designed. To minimize reflections, a gradual bend can be used. Alternatively, the 90° bend can be replaced by two 45° bends, spaced about one quarter wavelength apart for the frequency band where the antenna will be used. Because rays cross this bend at various angles, a particular spacing cannot be ideal for all rays, but a spacing can be chosen to minimize the reflections for rays crossing at some intermediate angle, thereby optimizing the performance of the lens as a whole.

Figure 4:
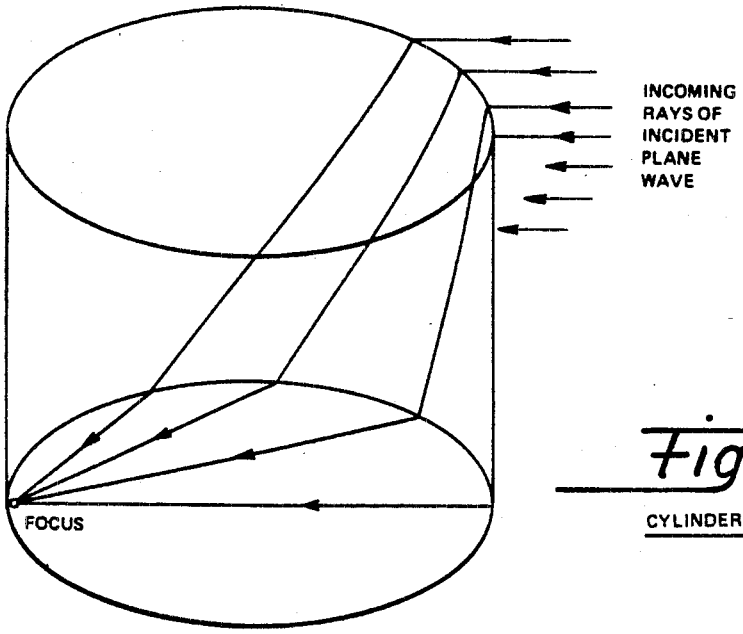

FIG. 4 shows a modification of the cylinder-disk lens concept. The change is the use of two different dielectric materials within the parallel-surface propagation regions. The dielectric constant in the disk region is made somewhat less than one-half of the dielectric constant in the cylinder region. The effect of this choice, together with the readjustment of the ratio of height to radius of the cylinder, is to move the focal point out to the perimeter of the disk region.

There is an added result of particular importance. The phase-error polynominal is now found to have a zero coefficient for both the $\theta^2$ and $\theta^4$ terms. As a result, the lens can be used with a relatively wide arc as the aperture associated with a particular antenna beam, and phase errors will be very small across this aperture. Appropriate amplitude tapering will then be able to provide very low sidelobes.

Figure 5:
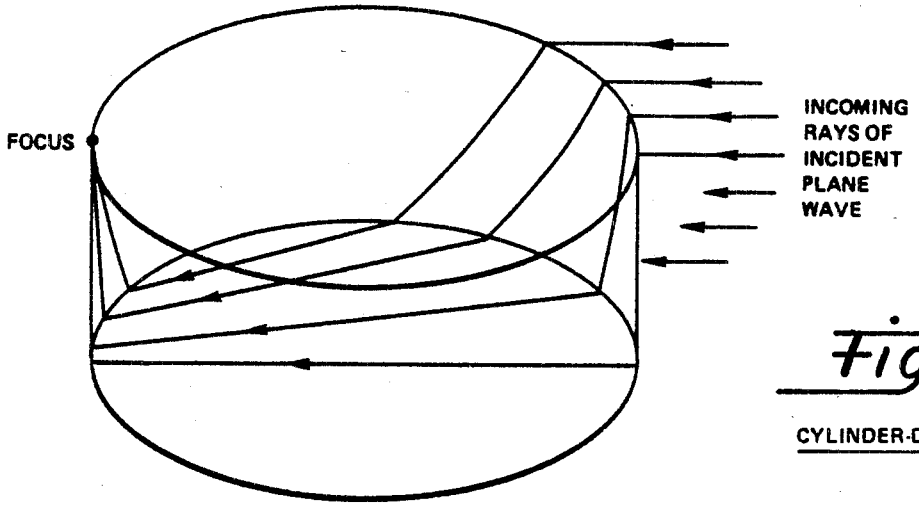

There can then be a second design change, shown in FIG. 5. The height of the cylinder is reduced by exactly one-half. Now the rays cross the disk before they can come to a focus. They turn up the side of the cylinder, and reach a focal point which is now positioned at the top of the cylindrical wall, just where the coupling ports are located.

Now the use of a circulator in each coupling cable will permit each coupling port to serve both as an input to the lens, carrying the signal received on one antenna element, and as an output to the receiver, carrying the focused signal for one receiving beam. This use of circulators corresponds directly to their use with the R-KR lens of FIG. 2. With circulators, the lens of FIG. 5 can provide a full 360° of receiving beams, without the cross-coupling problem mentioned in connection with the lens design of FIG. 3.

It is also possible to dedicate some ports to beam outputs only, the rest to antenna element inputs. In this way one lens can be used to cover a sector of 90° to 120°, other lenses being used for the remaining sectors. The ports can even be alternated between inputs from antenna elements and outputs carrying beam signals, at the cost of some loss of antenna gain, but with the benefit that one antenna can be used to cover the full 360°, without the expense of one circulator per beam. Close spacing of ports may be needed, to prevent the appearance of grating lobes.

Figure 6:
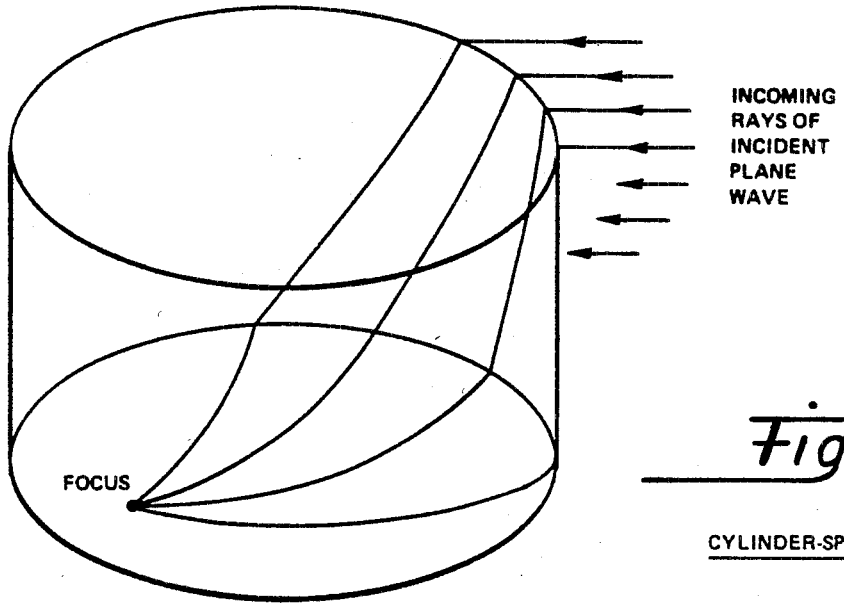
FIG. 6 is a symbolic diagram of a cylinder-sphere lens.

FIG. 6 shows a different lens design. Here there is a propagation region between closely spaced concentric cylinders, as in the previous designs, but this is joined to a spherical cap, instead of a disk. That is, the propagating region between cylindrical surfaces is joined to a propagating region between two surfaces which are portions of two concentric spheres.

As compared with the cylinder-disk of FIG. 3, there is now an additional parameter, the radius of curvature of the spherical-shell waveguide. This permits the removal of both $\theta^2$ and $\theta^4$ terms from the phase-error polynomial, as shown in the section "Lens Equations".

The resulting lens is highly corrected. Like the lens of FIG. 5, it can be used with amplitude tapers designed for low sidelobes with little risk that sidelobe levels will be increased as a result of phase errors.

The cylinder-sphere design of FIG. 6 is subject to the same two difficulties encountered with the cylinder-disk design of FIG. 3. Coupling between beams, resulting from rays heading for one focal point but crossing other focal points on the way, can be addressed as it was before. The use of one lens can be limited to a portion of the full 360° angular coverage, the remainder coming through the use of several other lenses. Alternatively, a lens design can be sought in which the focal points are moved to the upper periphery of the cylinder, where each input port can then also serve as an output port.

This approach will require the use of two different dielectric materials, one for the cylindrical parallel-surface region and the other for the spherical cap.

The joint between the cylindrical wall and the spherical cap is less abrupt than the joint between cylinder and disk, but it can nevertheless create reflections, particularly if there is a change of dielectric constant as well as an angular bend. These reflections can be minimized through making the transition gradual in angle, or breaking the angular change into two half-transitions, about a quarter-wavelength apart. If there is a change in dielectric constant, this change can be tapered, or it can be carried out in steps, spaced about a quarter-wavelength apart.

Figure 7:
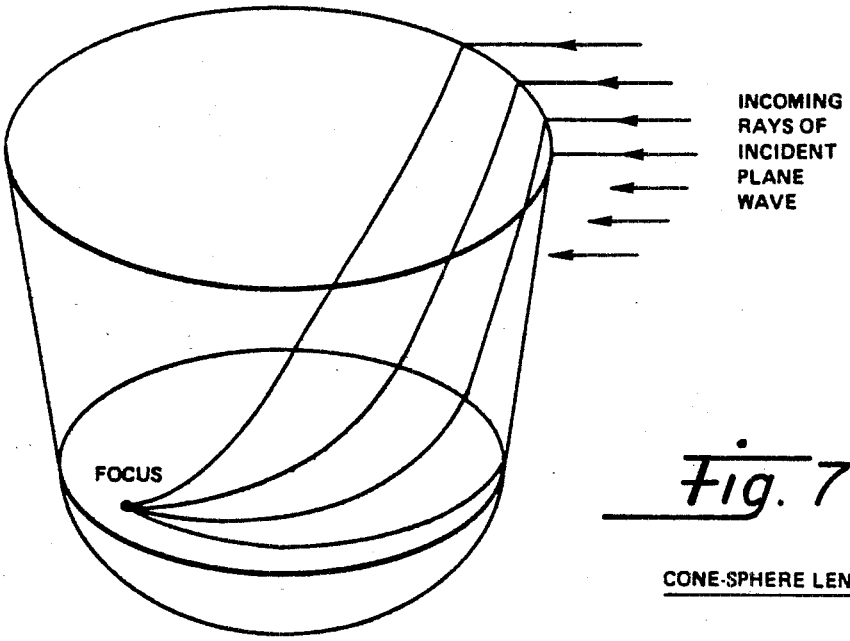

The angular transition between side and cap can be made continuous through the use of the modified design shown in FIG. 7. Here the side region is no longer a vertical cylinder, but is given a conical shape. That is, the propagating region lies between two closely spaced conical surfaces. The cap, as in the design of FIG. 6, is formed from two closely spaced concentric spherical surfaces, but now there is the constraint that the tangents to the spherical cap should also be tangent to the conical wall, along the arc where they join. The propagating rays curve smoothly and gradually, with no kinks, where they cross from cone to sphere. Thus, there should be no significant reflection at this juncture, as long as the dielectric constant does not change.

The continuous-slope constraint at the juncture modifies the mathematical analysis, but leaves enough adjustable parameters to permit the removal of both $\theta^2$ and $\theta^4$ terms from the phase-error polynomial.

The design of FIG. 7 should have no junction-reflection problem, but it does share the dificulty in the designs of FIGS. 3 and 6, arising from the rays for one focus crossing other focal points. The most straightforward solution, as before, involves the use of several lens antennas for 360° coverage, each covering only a limited sector, say 90° or 120°. In a multistatic receiving system, the subdivision of the coverage into several separate angular sectors will provide useful flexibility in choice of sites, and in the husbanding of signal-processing resources, since very few covert sites are likely to have a full 360°field of view from a single accessible location.

The cone-sphere design of FIG. 7 can be modified to place the focal point on the upper perimeter, as was done earlier in FIG. 5. For this, the dielectric constants of the conical side-wall region and the spherical cap are left separately adjustable, along with the conical, the height of the conical section and the radius of curvature of the spherical cap. It is found that the number of adjustable parameters is sufficient to permit the simultaneous vanishing of the $\theta^2$, $\theta^4$, and $\theta^6$ coefficients, together with the smooth joining of cone to sphere with no discontinuity in slope at the junction. There remains a discontinuity in dielectric constant, which will need to be tapered, or otherwise designed for minimum reflection.

This solution is found to be very open, nearly flat, with the conical half-angle equal to about 73.013°. The slant height of the conical section is 1.00078 times the radius of the spherical cap. The index of refraction within the spherical cap is 0.82495 times the index of refraction in the conical shell, while this in turn equals 2.53625 times the outside index of refraction, for the case where the array elements are arranged on a circle whose radius equals the outer radius of the conical angle section. When a different radius is used for the array elements, the corresponding choice in index of refraction can be obtained through use of Equation (M-27), given in the section "Lens Equations".

Figure 8:
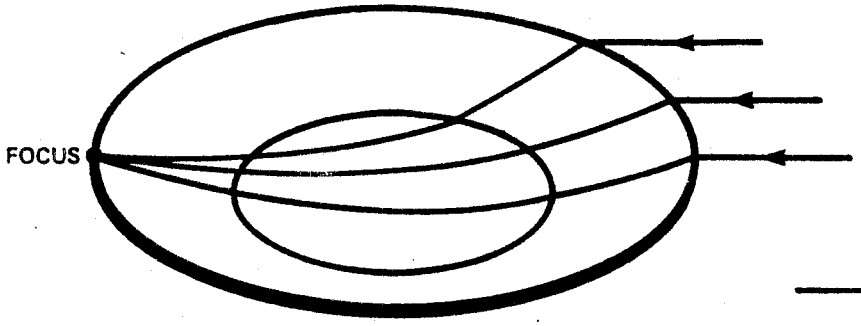
FIGS. 7 and 8 are symbolic diagrams of cone-sphere lenses.

FIG. 8 shows this shallow lens. Lenses of this design could be stacked, and phased to provide elevation-beam steering, or multiple beams in elevation. Furthermore, the use of nested pairs of lenses, with 3-db hybrid couplers at each corresponding pair of ports, would provide the equivalent of circulator action at each port, without the need to use circulators.

Further analysis of these lens configurations, and of other alternatives not mentioned here, could be carried out. The purpose would be to find lens designs which had very good phase accuracy across the radiating aperture and at the same time meet requirements for ease of construction, maintainability, and usefulness in the field.

In summary, the multibeam antenna designs which use the lenses of FIGS. 3–8, or modified lenses obtained from them, should provide enough precision of phasing across the receiving aperture to permit the use of amplitude tapering giving very low sidelobes. An approach to amplitude tapering, which has been used before and is applicable here, involves the weighted combination of three adjacent beams to give a composite beam with very low sidelobes (reference 4). This approach, and extensions of it, become more effective than before when the individual beams do not have phasing errors that create sidelobes of an irreducible character.

LENS EQUATIONS

Figure 9:
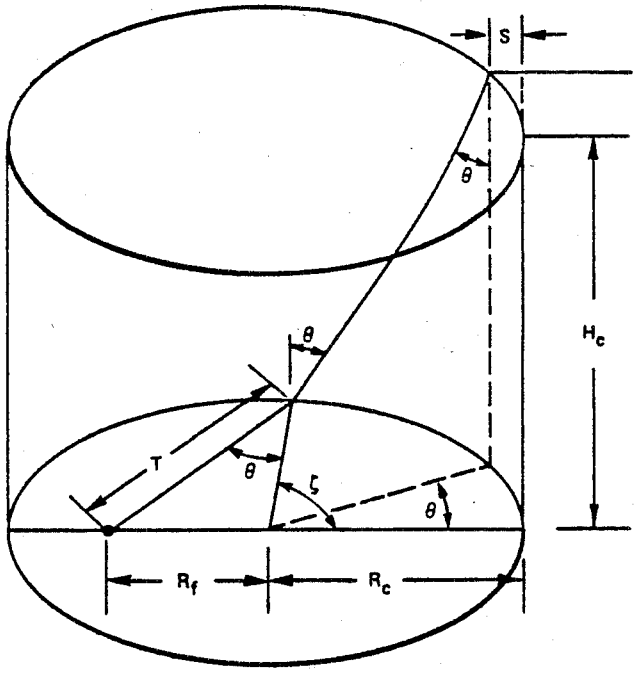
FIGS. 9–11 are the same as FIGS. 3, 4 and 6 respectively, showing the geometry with angles and distances labeled.

The geometry of the top-hat lens (cylinder-disk I), pictured in FIG. 3, is given again here in FIG. 9, with angles and distances labeled. For simplicity, the analysis assumes that all propagating regions shown in the figure have the same dielectric constant and therefore the same index of refraction. The more general case will be discussed later.

With the above assumption, the angle $\theta$, locating the incident ray which is being traced, serves also as the angle of refraction into the cylindrical parallel-surface region, at the top of FIG. 9. The cylinder shown is a right circular cylinder, so that this same angle $\theta$ is the angle of incidence at the junction between cylinder and disk, and also the angle of refraction into the disk-shaped parallel-plate region in the lower part of the figure.

The angle $\zeta$, in radian measure, is given by $$\zeta=\theta+H_c\tan\theta/R_c, \qquad \text{(M-1)}$$

as is obvious from the figure. When the cylindrical surface is unrolled and flattened out, it is seen to contain a right triangle whose sides are $H_c$ and $H_c \tan\theta$, and whose hypotenuse is $H_c \sec\theta$. This hypotenuse forms part of the ray which is being traced.

Another segment of the traced ray is indicated by the distance T in the figure. From the law of sines, it is evident that T satisfies the equation $$T=R_f\sin\zeta/\sin\theta. \qquad \text{(M-2)}$$

Another segment in the traced ray is given by $$S=R_c(1-\cos\theta). \qquad \text{(M-3)}$$

which is the amount by which the external portion of this ray exceeds the external portion of the central ray at $\theta=0$.

For a true focus to exist, and to have the location shown in FIGS. 3 and 9, there should be an equality of path lengths, as expressed in the equation $$H_c+R_c+R_f=S+H_c\sec\theta+T. \quad \text{(M-4)}$$

In the limiting case, as $\theta$ approaches zero, Equations (M-1) and (M-2) lead to $$T=R_f(1+H_c/R_c) \quad \text{(M-5)}$$

and substitution into (M-4) gives the limiting-case result $$H_c+R_c+R_f=H_c+R_f(1+H_c/R_c) \quad \text{(M-6)}$$

which is a relation between constant quantities and is no longer an approximation. This reduces to $$R_c^2=R_fH_c. \quad \text{(M-7)}$$

When the abbreviation $$p=H_c/R_c=R_c/R_f \quad \text{(M-8)}$$

is introduced into the general equation (M-4), this equation (after division by $R_c$) takes the form $$p+1+1/p=(1-\cos\theta)+p\sec\theta+\sin\zeta/p\sin\theta. \quad \text{(M-9)}$$

which can also be written as $$\sin(\theta+p\tan\theta)=\sin\theta++p\sin\theta\cos\theta-p^2(\tan\theta-\sin\theta). \quad \text{(M-10)}$$

The left-hand side of (M-10), expanded as a power series in $\theta$, is $$\sin(\theta+p\tan\theta)=(1+p)\theta+[2p-(1+p)^3]\theta^3/6+\ldots, \quad \text{(M-11)}$$

while the right-hand side of (M-10) expands to give $$\sin\theta+p\sin\theta\cos\theta-p^2(\tan\theta-\sin\theta)=(1+p)\theta+[-1-4p-3p^2]\theta^3/6+\ldots. \quad \text{(M-12)}$$

Comparison of the two expansions shows that the terms linear in $\theta$ already agree, as a result of the limiting-case analysis which led to the substitutions (M-8). There will be agreement of the $\theta^3$ portions of (M-11) and (M-12) only if the quantity p satisfies the equation $$p(3-p^2)=0 \quad \text{(M-13)}$$

This equation has three roots. The root p=0 is of no interest, and neither is the negative root. However, the positive root, $$p=\sqrt{3}, \quad \text{(M-14)}$$

is physically realizable and practicable, and leads to the design solution given earlier in Equations (1—1) and (1-2).

Figure 10:
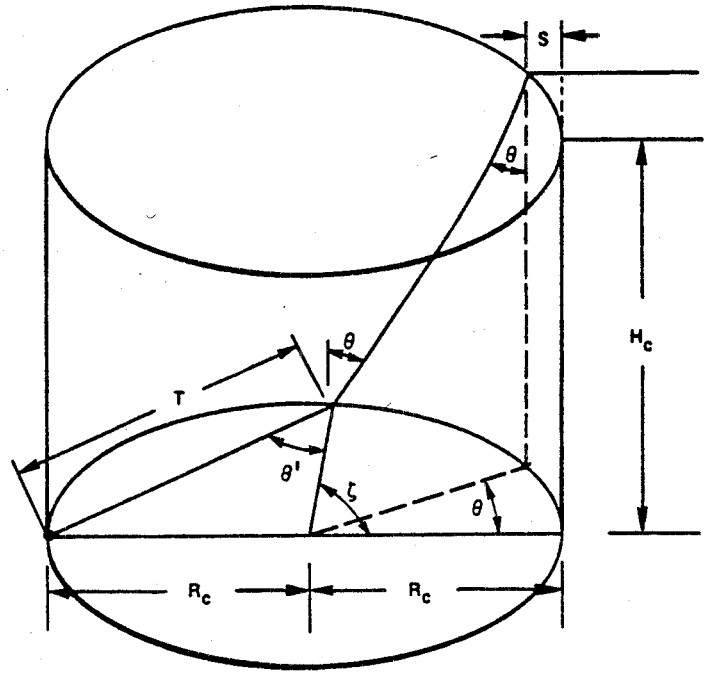

In the modified lens design of FIG. 4, shown here as FIG. 10, the focal point is constrained to lie on the disk perimeter. To permit this constraint, the dielectric constants for the disk and cylinder are allowed to differ. The refraction at the junction is then described by $$n'\sin\theta'=n\sin\theta. \quad \text{(M-15)}$$

wherein n' is the index of refraction in the disk region and n is the index of refraction in the cylinder region. The angle $\theta'$ is also related to the angle $\zeta$ through $$\theta'=\zeta/2. \quad \text{(M-16)}$$

and the path segment T is given by $$T=2R_c\cos\theta' \quad \text{(M-17)}$$

Now the path-length constraint for focusing, replacing Equation (M-4), will take the form:

$$nH_c+2R_c=nS+nH_c\sec\theta+n'T, \quad \text{(M-18)}$$

where S is still given by (M-3). For the purpose of this analysis, it is assumed that the outside propagation is through a medium, with the same dielectric constant as in the cylindrical parallel-surface propagation region, while only the disk region contains a different dielectric material.

Division of (M-18) by $R_c$, and the substitution of $$p=H_c/R_c, \quad \text{(M-19)}$$

gives the result $$np+2n'=n(1-\cos\theta+p\sec\theta)+2n'\cos(\zeta/2), \quad \text{(M-20)}$$

where $\zeta$ is given by $$\zeta=\theta+p\tan\theta. \quad \text{(M-21)}$$

Expansion of (M-20) as a power series in $\theta$, out through terms in $\theta^4$, leads to the two conditions $$1+p=2n/n'. \quad \text{(M-22)}$$

$$p^3+3p^3-9p-3=0 \quad \text{(M-23)}$$

Of the three roots of (M-23), only one is physically accessible. Its value is $$p=2.064278, \quad \text{(M-24)}$$

which the leads to the requirement $$n/n'=1.532089, \quad \text{(M-25)}$$

which translates into a requirement on dielectric constants of $$\epsilon/\epsilon'=2.347296 \quad \text{(M-26)}$$

It is evident from (M-26) that the dielectric constant in the cylindrical parallel-surface region, denoted here by $\epsilon$, will need to be no less than 2.347296, since the dielectric constant in the disk region cannot be less than unity. This restriction is not a severe one, however, and appropriate materials having the ratio of dielectric constants given in (M-26) will not be difficult to fine or, if necessary, to order to be made.

To simplify the analysis, it was assumed that the dielectric material in the cylindrical shell was the same as the dielectric material outside the lens structure. In practice, the incident wave will be arriving through air as the medium for propagation, with its dielectric constant $\epsilon_0$ and index of refraction $n_0$ both equal to unity. The incident wave may also be arriving from a specified elevation angle $\beta$.

This incident wave can be matched into the lens structure if the correct relationship is used between the radius of the circular array of receiving antenna elements and the (smaller) circle of coupling ports at the upper peiphery of the cylinder. Each antenna element will be connected to a corresponding coupling port by a cable, with all cables having the same length, as in the R-KR lens design shown in FIG. 2. The relationship between the cylinder radius $R_c$ and the array radius $R_a$ is:

$$R_c/R_a=(n_0/n)\cos\Gamma \quad \text{(M-27)}$$

where $n_o=1$. Given an available pair of dielectric materials, whose dielectric constants have the ratio (M-26), and given an array radius $R_a$ and an elevation angle $\beta$ for which the antenna is to be optimized, the lens radius $R_c$ can then be determined from Equation (M-27).

Equation (M-27) is general, and applies to all the proposed lens designs, in FIGS. 3–8. Increasing the dielectric constant in the cylindrical or conical region will permit the physical size of each lens to be reduced, while the physical size of the ring array of antenna elements is kept constant.

Figure 11:
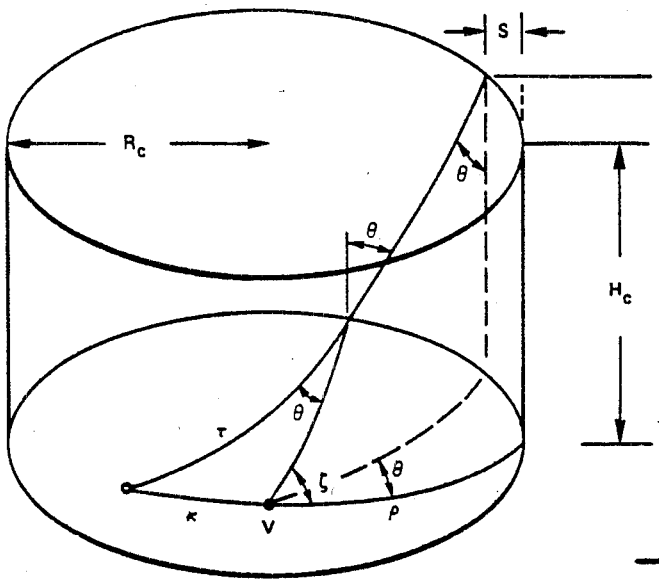

FIG. 11 shows the geometry for the cylinder-sphere lens design. Here the ray equations will be similar to those for FIG. 9, except that the final ray segment is a great-circle are crossing part of the spherical-cap region.

The height and radius of the cylindrical portion of the lens will be denoted by $H_c$ and $R_c$, as before. There is now an additional adjustable parameter, the radius of curvature of the spherical cap, which will be denoted by $R_s$. For convenience, dimension-less parameters p and q will be defined by:

$$p=H_c/R_c. \quad \text{(M-28)}$$

$$q=R_c/R_s. \quad \text{(M-29)}$$

The vertex of the spherical cap is denoted by the point V, in FIG. 11. Distances on the spherical surface are conventionally expressed as angles about the center of the sphere. This center is a point which has not been shown in the figure, but which would lie on the axis of the cylinder, at a height $R_s$ above the vertex point V.

With the geometry as shown in FIG. 11, the angle $\zeta$ is still given by the earlier Equation (M-1), and the angle $\theta$ is conserved at each refractive crossing point, as in FIG. 9. For use in equations from spherical trigonometry, all of the arc lengths on the spherical surface need to be expressed as angular arcs. In particular, the arc length denoted by $\rho$ has the magnitude, in radian units, of $$\rho=\sin^{-1}(R_c/R_s)=\sin^{-1}(q) \quad \text{(M-30)}$$

From the law of sines in spherical trigonometry, in analogy with (M-2), it is found that $$\sin\tau=\sin\kappa\sin\zeta/\sin\theta. \quad \text{(M-31)}$$

where $\tau$ is the extent in radians of the ray path segment analogous to T in FIG. 9. The matching of path lengths, in analogy with (M-4), gives the relationship:

$$H_c+R_s(\rho+\kappa)=S+H_c\sec\theta+R_s\tau, \quad \text{(M-32)}$$

in which S is given by (M-3). Division by $R_c$, and substitution from (M-28) and (M-29), gives:

$$p+(\rho+\kappa)/q=1-\cos\theta+p\sec\theta+\tau/q, \quad \text{(M-33)}$$

where $\tau$ can be written as:

$$\tau=\sin^{-1}[\sin\kappa\sin(\theta+p\tan\theta)/\sin\theta]. \quad \text{(M-34)}$$

When (M-34) is substituted into (M-33), the result is an equation in which $\theta$ is the only variable. Each term in this equation can be expanded as a power series and $\theta$, and the resulting terms grouped according to the increasing powers of $\theta$. Only even powers of $\theta$ appear. Requiring that the constant term, and the coefficients of $\theta^2$ and $\theta^4$, should all vanish leads to a set of simultaneous equations that can be solved for the three adjustable parameters p, q, and k.

The three simultaneous equations can be manipulated into the set $$\sin(k+\sin^{-1}q)=(1+p)\sin k, \quad \text{(M-35)}$$

$$\frac{1}{\sin^2\kappa}=(1+p)^2+\frac{p^4(3+p)^2}{9q^2(1+p)^2} \quad \text{(M-36)}$$

$$q^2=\frac{p^2(45+30p-6p^3-p^4)}{15(1+p)^4}. \quad \text{(M-37)}$$

A numerical solution of this set of equations has been obtained through an iterative procedure. A trial value of p is selected, which can be called $p_1$. This is substituted into (M-37) to give a value $q_1$, and then $p_1$ and $q_1$ are introduced into (M-36), giving $\kappa_1$. Now $\kappa_1$ and $q_1$ are used in (M-35), which is solved for $p_2$. If $p_1$ had been the correct p, then the $p_2$ obtained from (M-35) would equal $p_1$, and $$d_{21}=p_2-p_1 \quad \text{(M-38)}$$

would equal zero.

The output value $p_2$ is now used as a second trial input, giving a new output $p_3$ and a new difference $$d_{32}=p_3-p_2. \quad \text{(M-39)}$$

The "delta-square" process will now give an improved approximation $$\bar{p}=p_1-(d_{21})^2/(d_{32}-d_{21}). \quad \text{(M-40)}$$

This can be used as a new first trial value, and the process repeated, until the solution has converged and the differences $d_{21}$ and $d_{32}$ are negligible.

The solution obtained in this way gives the results:

$$\begin{aligned} p &= 1.07153253, \\ q &= 0.53339571, \\ \kappa &= 0.41046842, \\ \sin\kappa &= 0.39903888, \\ \sin q &= 0.56260998, \end{aligned} \quad \text{(M-41)}$$

From these results, substituted into Equations (M-28), (M-29), and (M-30), the lens geometry can be determined quantitatively.

While preferred constructional features of the invention are embodied in the structure illustrated herein, it is to be understood that changes and variations may be made by those skilled in the art without departing from the spirit and scope of my invention.

I claim:

1. A multibeam lens antenna unit in which a lens structure comprises closely spaced conductive plates with a dielectric medium between the plates, an aperture which is at least part of a circle along an edge of the lens structure, an antenna array comprising a plurality of array elements, arranged in a circular arc, a plurality of transmission lines coupling the array elements individually to element ports along the aperture for coupling RF energy between the array and the lens structure, a plurality of feed ports coupling the lens structure to transmission lines for coupling RF energy between the lens structure and radio equipment, each feed port being at a focus point for a particular beam direction at the antenna array;

the improvement wherein the lens structure comprises first and second portions, in the first portion the plates being surfaces of revolution about an axis, with first and second ends thereof being circles in planes perpendicular to the axis, the first end being said aperture; the second portion forming a cap with a circular periphery joined to the first portion at its second end; the dielectric constant and therefore the index of refraction being constant within each portion;

wherein the first portion and the second portion have different dielectric constants, the height of the first portion, the radius, the two dielectric constants, and other parameters being such that the focus for any beam falls on the periphery of the second portion.

2. A lens antenna according to claim 1, with means for precision of phasing across the receiving aperture to permit the use of amplitude tapering giving very low sidelobes.

3. A lens antenna according to claim 2, wherein the first portion and the second portion are joined together so that the joint in any axial plane is not a single sudden turn.

4. A lens antenna according to claim 3, wherein the first portion is cylindrical, and the second portion is a disk.

5. A lens antenna according to claim 3, wherein the first portion is conical and the second portion is a disk.

6. A lens antenna according to claim 3, wherein the first portion is conical and the second portion is a disk.

7. A multibeam lens antenna unit in which a lens structure comprises closely spaced conductive plates with a dielectric medium between the plates, an aperture which is at least part of a circle along an edge of the lens structure, an antenna array comprising a plurality of array elements, arranged in a circular arc, a plurality of transmission lines coupling the array elements individually to element ports along the aperture for coupling RF energy between the array and the lens structure, a plurality of feed ports coupling the lens structure to transmission lines for coupling RF energy between the lens structure and radio equipment, each feed port being at a focus point for a particular beam direction at the antenna array;

the improvement wherein the lens structure comprises first and second portions, in the first portion the plates being surfaces of revolution about an axis, with first and second ends thereof being circles in planes perpendicular to the axis, the first end being said aperture; the second portion forming a cap with a circular periphery joined to the first portion at its second end; the dielectric constant and therefore the index of refraction being constant within each portion;

wherein the first portion and the second portion have different dielectric constants, the height of the first portion, the radius, the two dielectric constants, and other parameters being such that the focus for any beam falls at said aperture.

8. A lens antenna according to claim 7, with means for precision of phasing across the receiving aperture to permit the use of amplitude tapering giving very low sidelobes.

9. A lens antenna according to claim 8, wherein the first portion and the second portion are joined together so that the joint in any axial plane is not a single sudden turn.

10. A lens antenna according to claim 9, wherein the first portion is cylindrical, and the second portion is a disk.

11. A multibeam lens antenna unit in which a lens structure comprises closely spaced conductive plates with a dielectric medium between the plates, an aperture which is at least part of a circle along an edge of the lens structure, an antenna array comprising a plurality of array elements, arranged in a circular arc, a plurality of transmission lines coupling the array elements individually to element ports along the aperture for coupling RF energy between the array and the lens structure, a plurality of feed ports coupling the lens structure to transmission lines for coupling RF energy between the lens structure and radio equipment, each feed port being at a focus point for a particular beam direction at the antenna array;

the improvement wherein the lens structure comprises first and second portions, in the first portion the plates being surfaces of revolution about an axis, with first and second ends thereof being circles in planes perpendicular to the axis, the first end being said aperture; the second portion forming a cap with a circular periphery joined to the first portion at its second end; the dielectric constant and therefore the index of refraction being constant within each portion;

wherein in the second portion the two closely spaced conductive plates are spherical.

12. A lens antenna according to claim 11, wherein the first portion and the second portion are joined together so that the joint in any axial plane is not a single sudden turn, wherein the first portion and the second portion have different dielectric constants, and the transition from one dielectric constant to the other is designed to reduce reflection;

with means for precision of phasing across the receiving aperture to permit the use of amplitude tapering giving very low sidelobes.

13. A lens antenna according to claim 12, wherein in the first portion the two conductive plates are conical, with smooth joining of the first portion to the second portion with no discontinuity in slope at the junction.

14. A lens antenna according to claim 13, wherein the height of the first portion, the radii, the two dielectric constants, and other parameters are such that the focus for any beam falls on said aperture.

15. A lens antenna according to claim 13, wherein the height of the first portion, the radius, the two dielectric constants, and other parameters are such that the focus for any beam falls on the periphery of the second portion.

16. A lens antenna according to claim 12, wherein in the first portion the two closely spaced conductive plates are cylindrical.

17. A lens antenna according to claim 16, wherein the height of the first portion, the radii, the two dielectric constants, and other parameters are such that the focus for any beam falls on said aperture.

18. A lens antenna according to claim 16, wherein the height of the first portion, the radius, the two dielectric constants, and other parameters are such that the focus for any beam falls on the periphery of the second portion.

* * * * *

UNITED STATES PATENT AND TRADEMARK OFFICE

CERTIFICATE OF CORRECTION

PATENT NO. : 4,558,324

DATED : December 10, 1985

INVENTOR(S) : Roger E. Clapp

It is certified that error appears in the above-identified patent and that said Letters Patent is hereby corrected as shown below:

Column 2, line 46, "regractive" should be "refractive".

Column 10, equation M-18, "$2R_c$" should be "$2n'R_c$".

Column 11, equation M-27, "$\cos\Gamma$" should be "$\cos\beta$".

Column 12, line 12, "and" should be "in".

Claim 6, line 1, "3" should be "9".

Signed and Sealed this

*Fifteenth* Day of *July 1986*

[SEAL]

*Attest:*

DONALD J. QUIGG

*Attesting Officer*

*Commissioner of Patents and Trademarks*